US009580279B2

(12) United States Patent
Bolme et al.

(10) Patent No.: US 9,580,279 B2
(45) Date of Patent: Feb. 28, 2017

(54) MAINTENANCE METHOD FOR AN ELEVATOR

(71) Applicant: Inventio AG, Hergiswil (CH)

(72) Inventors: Ole Bolme, Meggen (CH); Harald Schwark, Buchrain (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 14/653,964

(22) PCT Filed: Dec. 3, 2013

(86) PCT No.: PCT/EP2013/075391
§ 371 (c)(1),
(2) Date: Jun. 19, 2015

(87) PCT Pub. No.: WO2014/095352
PCT Pub. Date: Jun. 26, 2014

(65) Prior Publication Data

US 2015/0314992 A1 Nov. 5, 2015

(30) Foreign Application Priority Data

Dec. 19, 2012 (EP) ..... 12198161

(51) Int. Cl.
*B66B 19/00* (2006.01)
*B66B 5/00* (2006.01)

(52) U.S. Cl.
CPC ..... *B66B 19/00* (2013.01); *B66B 5/0087* (2013.01); *B66B 19/002* (2013.01)

(58) Field of Classification Search
CPC ..... B66B 19/00; B66B 19/002; B66B 5/087
USPC ..... 187/414
See application file for complete search history.

(56) References Cited

U.S. PATENT DOCUMENTS 3,763,964 A * 10/1973 Davis ..... B66B 9/187 187/239
3,851,736 A * 12/1974 Westlake ..... B66B 19/002 29/429
4,345,671 A * 8/1982 Tosato ..... B66B 19/002 29/429
5,065,843 A * 11/1991 Richards ..... B66B 19/002 187/408
5,230,404 A * 7/1993 Klein ..... B66B 19/00 187/414
6,357,556 B1 * 3/2002 Pettersson ..... B66B 5/04 187/414
6,422,352 B1 * 7/2002 Pettersson ..... B66B 19/002 187/408

(Continued)

FOREIGN PATENT DOCUMENTS

JP S642986 A 1/1989
JP 2011140374 A 7/2011

*Primary Examiner* — Michael Riegelman
(74) *Attorney, Agent, or Firm* — Fraser Clemens Martin & Miller LLC; William J. Clemens

(57) ABSTRACT

A maintenance method for an elevator includes provision of a service platform in a lower region of the elevator, in particular a shaft pit, for later maintenance work, wherein the service platform was previously mounted for installation purposes on at least one set of car guide rails and served in the installation process as a working platform for mounting elevator components in the elevator shaft, in particular on a shaft wall.

8 Claims, 2 Drawing Sheets

(56) References Cited

U.S. PATENT DOCUMENTS

| | | | | |
|---|---|---|---|---|
| 7,635,049 | B2 * | 12/2009 | Van Der Meijden | B66B 19/002 187/401 |
| 8,720,032 | B2 * | 5/2014 | Van Der Meijden | B66B 19/02 187/414 |
| 2003/0136611 | A1 * | 7/2003 | Erny | B66B 19/00 187/401 |
| 2005/0275161 | A1 * | 12/2005 | Fischer | B66B 19/005 271/277 |
| 2009/0223751 | A1 * | 9/2009 | Peacock | B66B 19/00 187/414 |
| 2010/0133048 | A1 | 6/2010 | Barneman | |
| 2013/0233655 | A1 * | 9/2013 | Peacock | B66B 19/00 187/414 |
| 2013/0284543 | A1 * | 10/2013 | De Jong | B66B 11/00 187/249 |
| 2014/0000987 | A1 * | 1/2014 | Peacock | B66B 19/00 187/414 |
| 2015/0314993 | A1 * | 11/2015 | Bolme | B66B 19/002 52/741.1 |

* cited by examiner

MAINTENANCE METHOD FOR AN ELEVATOR

FIELD

The invention relates to a maintenance method for an elevator, particularly for the maintenance of elevators in high buildings.

BACKGROUND

By a building of a high constructional height there is to be understood a building from approximately 30 floors and higher. Installation of an elevator is relatively costly in the case of such high buildings. Special methods and devices are often provided for the installation so that the installation can be carried out efficiently in terms of time.

US 2010/0133048 A1 shows, for example, an installation method for an elevator in a high building, in which use is made of a movable installation platform. At the start of the installation method the installation platform is positioned in the region of the shaft pit. Elevator components are constantly brought to the elevator installation from where these are mounted in the shaft area. In that case, the installation method provides that the installation platform is moved upwardly into different mounting positions by means of a hoist until the installation platform reaches an uppermost or last mounting position. Finally, the installation platform itself serves at least as a sub-structure of the elevator car.

This installation method is thus distinguished not only by an efficient procedure, but also by optimum utilization of the structures already present during the installation, in that the installation platform or at least parts thereof are incorporated into the later elevator car.

SUMMARY

An object of the present invention can therefore be seen in the extension of the use of an elevator component, which was previously used in an installation method, for later applications in the elevator, particularly also for maintenance applications.

The object is fulfilled by a maintenance method with the following step:

providing a service platform in a lower travel region of the elevator, particularly a shaft pit, for later maintenance operations, wherein the service platform was for installation purposes mounted beforehand on at least one pair of car guide rails and in that case served as work platform for the mounting of elevator components on a structure, particularly a shaft wall, bounding the travel region.

The advantage of this maintenance method resides in the fact that a previously used installation platform can also serve as a service platform for maintenance purposes. In particular, the service platform can be used twice. This leads not only to optimized utilization of the service platform itself, but also to an optimized sequence in terms of time of the preceding installation method as well as the maintenance method itself, since the installation platform can be provided for a new use without costly conversion work.

It is especially advantageous if the service platform is already guided at car guide rails. The service platform can in that regard be provided in a defined position in a lower travel region of the elevator and sets clear physical boundary conditions for normal operation of the elevator. In addition, the service platform is rapidly available for maintenance work below the elevator car and is safely operable thanks to the reliable guidance at the car guide rails.

Further steps of the maintenance method concern suspension of the service platform at the elevator car and movement of the service platform by means of a drive of the elevator car into a maintenance position. In that case it is particularly advantageous that it is possible to have resort to an already available drive for movement of the service platform.

A further step of the maintenance method relates to suspension of the service platform at the elevator car by means of at least one connecting element, wherein the connecting element comprises at least one of the following elements: a chain, a cable, a rope, a belt or a tension rod. The service platform can be coupled to the elevator car particularly simply and reliably by means of such a connecting element. In that case, provided not only at the underside of the elevator car, but also at the service platform are connecting points for the connecting element, at which, for example, the connecting element can be hooked, clamped or detented in place or screw-connected.

A further step of the maintenance method concerns removal of a roof construction from the service platform prior to providing the service platform in the lower travel region and/or removal of a guide extension from the service platform prior to providing the service platform in the lower travel region. The roof construction offers, during installation, protection from objects falling down and is no longer needed for maintenance work, particularly since the elevator car already offers sufficient protection. The guide extension conducts the guidance forces into a lower region, which is better anchored during installation of the car guide rails, of the already mounted car guide rails. The guide extension is also no longer needed for the maintenance operations. In that case it is advantageous that little space has to be provided for provision of the service platform in the lower travel region.

DESCRIPTION OF THE DRAWINGS

The maintenance method is further explained on the basis of further embodiments and drawings, in which.

DETAILED DESCRIPTION

Figure 1:
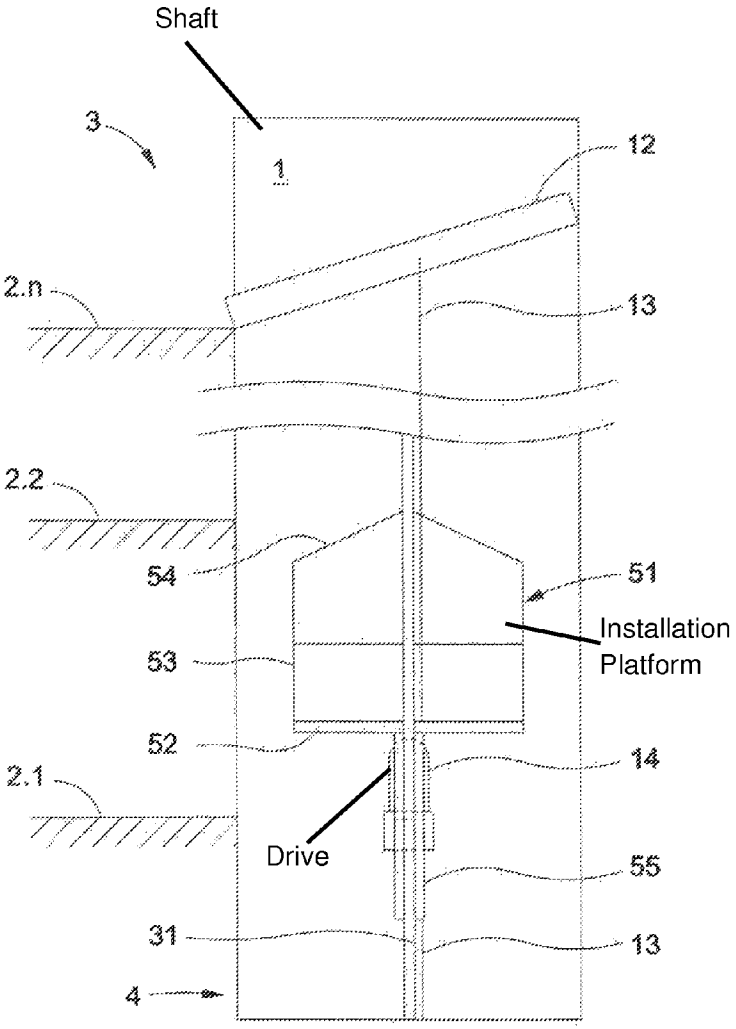
FIG. 1 shows an elevator shaft with a service platform for installation purposes.

FIG. 1 shows a shaft 1 of a building with a plurality of floors 2.1, 2.2, **2.*n***, during installation of an elevator.

A girder 12 is mounted at the level of the uppermost floor **2.*n* in the upper region 3 of a shaft 1 to protrude at an inclination into the shaft 1. In that case, a first end, here the left-hand end, of the girder 12 is pivotably mounted on the floor of the uppermost floor 2.*n* and a second end remote therefrom, here the right-hand end, is leant against a side wall of the shaft 1**.

The girder 12 has a suspension point for a hoist. This suspension point can be designed as, for example, an eye. The hoist comprises at least one support means or device 13, such as, for example, a cable, and a drive 14 which is automotively movable along the support means 13. The support means 13 can be simply mounted at the suspension point of the girder 12 by a hook.

In addition, an installation platform 51 is mounted on car guide rails 31 to be movable. The installation platform 51 serves, during installation of the elevator, as a work platform, which is movable along the already mounted car guide rails 31 and from which an engineer mounts elevator components at the region of the shaft 1. For that purpose the installation platform 51 is connected on its underside with the drive 14. This connection can be produced, for example, simply and reliably by way of screw connections. In the illustrated embodiment the installation platform 51 comprises three sub-modules, namely a basic platform 52 with a balustrade 53, which bounds the standing area of the basic platform 52, a guide extension 55 and roof construction 54. The guide extension 55 is mountable on the basic platform 52 and conducts guidance forces into a lower, more stable region of the cage car guide rails 31. This makes it possible to move the service platform 51 to a highest possible work position. Finally, the roof construction 54 offers protection to engineers from objects which are falling down.

Figure 2:
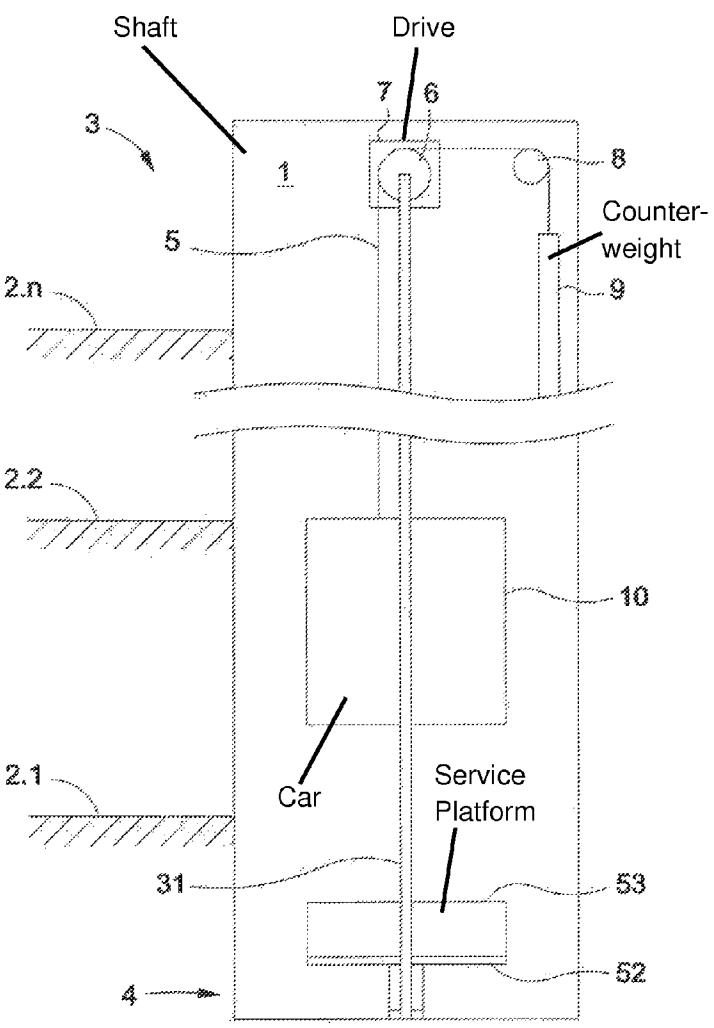
FIG. 2 shows the elevator in the elevator shaft of FIG. 1 with the service platform provided in the shaft pit.

FIG. 2 shows the finally installed elevator. The elevator comprises at least one elevator car 10 and counterweight 9 for compensation for weight forces. For that purpose the elevator car 10 and the counterweight 9 are each suspended at one end of traction means or device 5 in the suspension ratio 1:1. The traction means 5 runs in the upper region 3 of the shaft 1 at least over a traction pulley 6, which is operatively connected with the drive 7, and over a deflecting roller 8. The elevator car 10 can be moved to the floors 2.1, 2.2, **2.*n* by means of the drive 7**.

In addition, the installation platform re-functions as the service platform 51 as illustrated in FIG. 2. The service platform 51 comprises at least the basic platform 52 and the balustrade 53. In that regard, the roof construction 54 as well as the guide extension 55 were removed before provision of the service platform 51. Finally, the service platform 51 is provided in a lower region 4 of the elevator, particularly a shaft pit 4, for later maintenance work.

Figure 3:
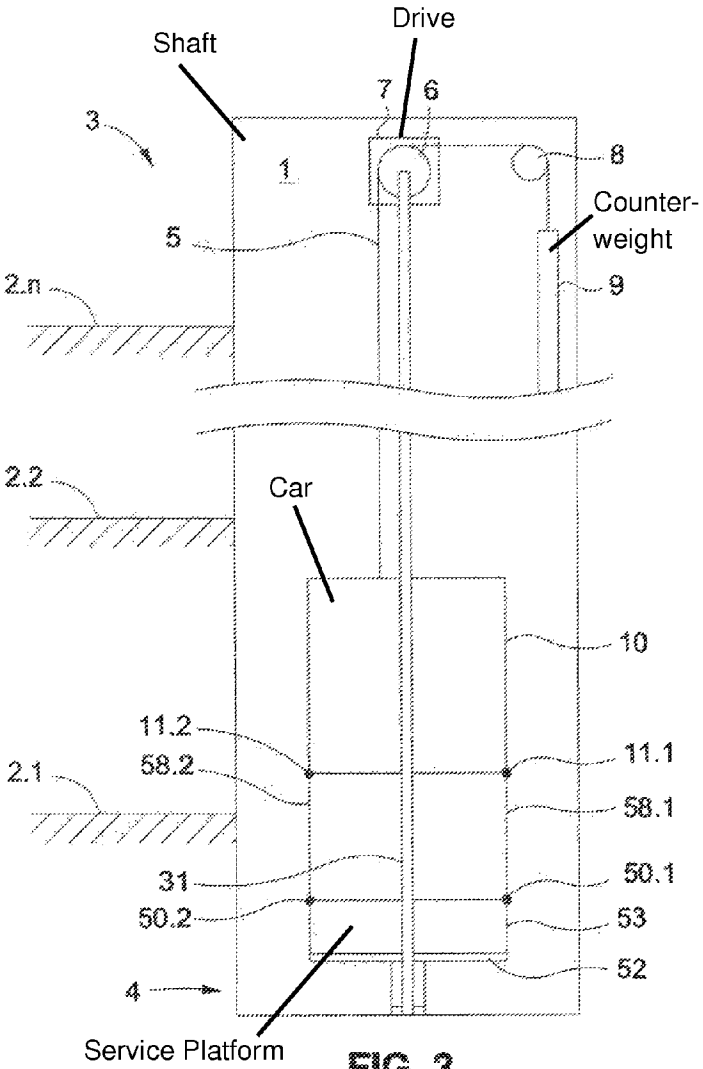
FIG. 3 shows the elevator of FIG. 1 in maintenance operation with the service platform suspended at the elevator car.

FIG. 3 shows the service platform 51 as suspended at the elevator car 10 by way of connecting elements 58.1, 58.2. Chains, cables, ropes, belts or tension rods are suitable as connecting elements 58.1, 58.2. In order to be able to suspend the service platform 51 at the elevator car 10 in simple and reliable manner, connecting points 11.1, 11.2 and 50.1, 50.2 are arranged both at the underside of the elevator car 10 and at the service platform 51. A respective connecting element 58.1, 58.2 can be hooked, clamped or detented in place or screw-connected at these connecting points 11.1, 11.2, 50.1, 50.2. For preference, four connecting elements 58.1, 58.2 are provided in the edge region of the service platform 51 so that the service platform 51 offers a secure footing for maintenance engineers.

The service platform 51 can now be moved by means of the drive 7 of the elevator car 10 to different maintenance positions in order to service elevator components which are accessible below the elevator car 10 at different levels in the shaft 1. Thus, for example, guide rails 31, the counterweight 9, shaft doors, electrical installations, sensors, etc., can be serviced from the service platform 51.

Figure 4:
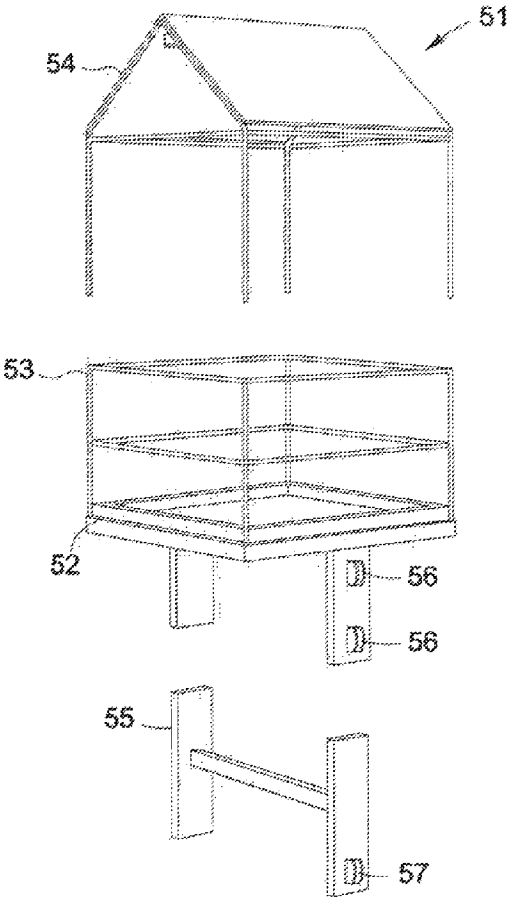
FIG. 4 shows an embodiment of the service platform.

FIG. 4 shows an embodiment of the service platform 51. The service platform 51 comprises the basic platform 52 and the balustrade 53. The roof construction 54 and the guide extension 55, which have the guide elements 57, are removed from the installation platform before providing the service platform 51. Guidance of the service platform 51 at the car guide rails 31 is ensured by the guide elements 56. The guide elements 56, 57 shown here are designed as sliding guide shoes.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A maintenance method for an elevator comprising the steps of:

providing an installation platform mounted on car guide rails in an elevator shaft;

using the installation platform for mounting elevator components in the elevator shaft; and after the elevator components are mounted in the elevator shaft, converting the installation platform to a service platform for performing maintenance work in the elevator shaft, the service platform being positioned below an elevator car mounted on the car guide rails, and suspending the service platform from the elevator car when the maintenance work is to be performed.

2. The maintenance method according to claim 1 wherein the step of converting includes removing a roof construction from the installation platform.

3. The maintenance method according to claim 1 wherein the step of converting includes removing a guide extension from the installation platform.

4. The maintenance method according to claim 1 comprising the further step of suspending the service platform from the elevator car by at least one connecting element.

5. A maintenance method for an elevator comprising the steps of:

providing an installation service platform in a shaft pit of an elevator shaft for performing installation work in the elevator shaft;

mounting the installation platform on car guide rails in the elevator shaft;

using the installation platform for installation of elevator components in the elevator shaft;

converting the installation platform to a service platform;

suspending the service platform from an elevator car in the elevator shaft for performing maintenance work; and moving the service platform into a maintenance position in the elevator shaft by a drive of the elevator car.

6. The maintenance method according to claim 5 comprising a further step of suspending the service platform from and in proximity to the elevator car by at least one connecting element, wherein the connecting element is at least one of a chain, a cable, a rope, a belt and a tension rod.

7. The maintenance method according to claim 5 comprising a further step of removing a roof construction from the installation platform to convert the installation platform into the service platform.

8. The maintenance method according to claim 5 comprising a further step of removing a guide extension from the installation platform to convert the installation platform into the service platform.

* * * * *